US006352165B1

(12) United States Patent
DiFelice

(10) Patent No.: US 6,352,165 B1
(45) Date of Patent: Mar. 5, 2002

(54) REPLACEMENT CAP AND PRESSURIZING MECHANISM FOR BOTTLE

(76) Inventor: Dion P. DiFelice, 67 Acadia Dr., Welland, Ontario (CA), L3C 6L4

( * ) Notice: Subject to any disclaimer, the term of this patent is extended or adjusted under 35 U.S.C. 154(b) by 0 days.

(21) Appl. No.: 09/496,585

(22) Filed: Feb. 2, 2000

(51) Int. Cl.[7] ..... B65D 41/04

(52) U.S. Cl. ..... 215/228; 141/24; 141/64; 220/212

(58) Field of Search ..... 215/228, 329; 220/212; 141/67, 22–24, 63, 64

(56) References Cited

U.S. PATENT DOCUMENTS

| | | | | |
|---|---|---|---|---|
| 3,557,986 A | | 1/1971 | Poole, Jr. | |
| 3,602,387 A | | 8/1971 | Patnaude | |
| 3,820,576 A | * | 6/1974 | Torrent | 141/24 |
| 4,033,091 A | * | 7/1977 | Saponara | 215/228 |
| 4,524,877 A | | 6/1985 | Saxby et al. | |
| 4,640,426 A | * | 2/1987 | Wasley | 215/228 |
| 4,723,670 A | | 2/1988 | Robinson et al. | |
| 4,768,665 A | | 9/1988 | Ballas | |
| 4,838,324 A | | 6/1989 | Boyd | |
| 4,899,896 A | | 2/1990 | Metzger | |
| 4,981,233 A | | 1/1991 | Scheurer | |
| 5,154,112 A | * | 10/1992 | Wettern | 215/228 X |
| 5,207,339 A | * | 5/1993 | Shyu | 215/228 |
| 5,653,352 A | | 8/1997 | Kim | |
| 5,823,372 A | | 10/1998 | Levine | |
| 6,076,570 A | * | 6/2000 | Byrne | 141/64 X |

* cited by examiner

*Primary Examiner*—Allan N. Shoap
*Assistant Examiner*—Robin A. Hylton

(57) ABSTRACT

An apparatus for sealing and pressurizing a bottle having an opening in a top end section and external threads extending around the end section includes an internal cap section having a bottom end with a bottom opening, a top end, and a generally cylindrical side wall located between the two ends. This cap section forms a chamber adapted to receive at least a portion of the top end section and has internal threads formed in this chamber and adapted for engaging the external threads in order to detachably mount the apparatus on the bottle. An annular compressing plate is mounted on the cap section so as to be movable upwardly or downwardly thereon. This compressing plate is non-rotatable relative to the cap section. A resilient, expandable and compressible bellows is located above the compressing plate and around the cap section. There is an exterior cover member that has a cylindrical side wall with interior threads in operative engagement with the edge of the plate. Rotation of the cover member to a sufficient extent causes the bellows to be compressed by upward movement of the plate.

20 Claims, 3 Drawing Sheets

REPLACEMENT CAP AND PRESSURIZING MECHANISM FOR BOTTLE

BACKGROUND OF THE INVENTION

This invention relates to devices capable of increasing air pressure within a bottle or other container, for example a beverage bottle.

It is well known that carbonated beverages will lose at least some of their pleasing taste if the carbonation contained in the beverage liquid is permitted to dissipate. The problem of the deterioration in the taste of a carbonated beverage is only partially alleviated by replacing the cap or cover on the top opening of the bottle, if this can be done at all. For example, in the case of a well-known plastic beverage container which has a top opening with external threads extending around the exterior of the opening, it is possible to seal this container again by replacing the cap which is internally threaded. However there is no means with even a container of this type for increasing the amount of pressure within the container after it has been opened. Further openings of the container of course allow more pressurized gas to escape into the atmosphere through the open top. In the case of some pop containers, such as metal cans and bottles with top outlets that are not threaded, it can be difficult if not impossible to reseal the container to prevent the carbonation from escaping.

A variety of pumping devices have been proposed in the past for repressurizing a beverage container in order to preserve the taste of the beverage. One such apparatus is described in U.S. Pat. No. 4,524,877 which issued Jun. 25, 1985 to Willlard A. Saxby et al. This known pressurizing enclosure device includes an elongate cylinder with a threaded cap at one end and a piston passing through a circular opening in the cap and centrally located in the cylinder. The cap is threaded to the outside threads of the mouth of the container. There is a handgrip at one end of the piston member so this member can be moved up and down in the cylinder. A cup seal is mounted at the bottom end of the piston and at the bottom of the cylinder is a resilient pressure valve that permits air to flow out of ports in the bottom of this cylinder and into the container but air cannot flow in the reverse direction.

More recent U.S. Pat. No. 5,823,372 which issued Oct. 20, 1998 to Alan Levine teaches another form of pumping device for mounting in the top opening of a bottle, this device employing a hollow, resilient expandable and compressible bellows like body. The top end of this body has a flanged lip seal that is adapted to engage inside a standard bottle cap and there is a hole in the upper end. A membrane covers a normally sealed opening in the lower end of the body. A mounting collar extends around the lower end of the bellows member and can sealingly engage a bottle neck. One difficulty with this pump insert is that the bellows member is quite small and clearly the device would have to be operated repeatedly by moving the bottle cap upwardly and downwardly in order to add a reasonable amount of pressurized air to the interior of the bottle.

It is an object of the present invention to provide a relatively inexpensive apparatus that is both capable of sealing and pressurizing a container, such as a bottle, having an outlet in one end thereof and external threads extending around this outlet.

It is a further object of the present invention to provide an apparatus for sealing and pressurizing a container, such as a bottle, that is relatively easy to use and that can be operated to both seal and pressurize the container by simple rotation of an exterior body a predetermined amount.

It is a further object of the present invention to provide an apparatus for sealing and pressurizing a container that employs a simple resilient, expandable and compressible bellows and a simple mechanism for compressing the bellows in order to force air from the bellows into the container.

According to one aspect of the invention, an apparatus for sealing and pressurizing a bottle having an opening for allowing a liquid to flow out of the bottle, this opening being formed in an upper section of the bottle having external connecting threads formed thereon, includes a connecting and sealing member having a cavity capable of receiving the upper section of the bottle and internal connecting threads extending around the periphery of the cavity and adapted for engaging the external connecting threads of the bottle in order to detachably mount the apparatus on the bottle. There are resilient, expandable and compressible bellows having an opening for passage of air into and out of the bellows and a movable compressing member for engaging an end of the bellows, this member being capable of compressing the bellows when it is moved towards the bellows. A rotatable exterior body contains the bellows and engages the compressing member so that rotation of this body about a central axis thereof causes the compressing member to move towards the bellows. During use of the apparatus, compression of the bellows forces compressed air to flow from the bellows through the opening therein and into the bottle and the apparatus forms a sealing closure over the opening in the bottle.

Preferably the compressing member is an annular plate having an exterior edge and the exterior body has a cylindrical side wall with internal threads formed thereon, whereby the internal threads slidably engage the exterior edge of the plate.

According to another aspect of the invention, an apparatus for sealing and pressurizing a container having an outlet in one end thereof and external threads extending about this outlet includes a resilient, expandable and compressible bellows having an opening for air to pass into and out of the bellows. There is also a connecting member for detachably and sealingly mounting the bellows on the container at the outlet. This connecting member is formed with internal threads for engaging the external threads at the outlet and is connected to the bellows. A movable compressing member for engaging an end of the bellows is capable of compressing same when the compressing member is moved towards the bellows. A rotatable body engages said compressing member so that rotation of the body a predetermined amount causes the compressing body to move towards the bellows and compress same. When the apparatus is used and is connected to the container, compression of the bellows forces compressed air to flow from the bellows through the opening therein and into the container and the apparatus forms a sealing closure over the outlet.

A preferred connecting member forms a cylindrical cavity sized to receive the outlet of the container and having an open bottom. This connecting member has an upper end section adapted to sealingly engage a rim of the container outlet when the apparatus is connected to the container.

According to still another aspect of the invention, an apparatus for sealing and pressurizing a bottle having an opening on a top end section and external threads extending about this top end section includes an internal cap section having a bottom end with a bottom opening, a top end, and a generally cylindrical side wall located between these ends. The cap section forms a chamber adapted to receive at least a portion of said top end section and has internal threads formed in the chamber and adapted for engaging the external threads in order to detachably mount the apparatus on the bottle. An annular compressing plate is mounted on the cap section as to be moved upwardly or downwardly on the cylindrical side wall around which the compressing plate extends. This plate is non-rotatable relative to the cap section. A resilient, expandable and compressible bellows is located above the compressing plate and is arranged around the cap section. This bellows has an opening for passage of air into or out of the bellows. An exterior cover member has a cylindrical side wall that has interior threads formed on the inside thereof in operative engagement with the circumferential edge of the compressing plate. Rotation of the cover member in a predetermined direction to a sufficient extent causes the bellows to be compressed by upward movement of the compressing plate relative to the cap section. During use of the apparatus, the compression of the bellows forces compressed air to flow from inside of the bellows into the bottle and the apparatus forms a sealing closure over the opening and the top end section of the bottle.

In a preferred embodiment, the bellows has a central bottom aperture into which the cap section extends and a closed top that extends over the top end of the cap section. The opening in the bellows is located centrally in an interior section of the bellows.

Further features and advantages will become apparent from the following detailed description taken in conjunction with the accompanying drawings.

DETAILED DESCRIPTION OF PREFERRED EMBODIMENTS

Figure 1:
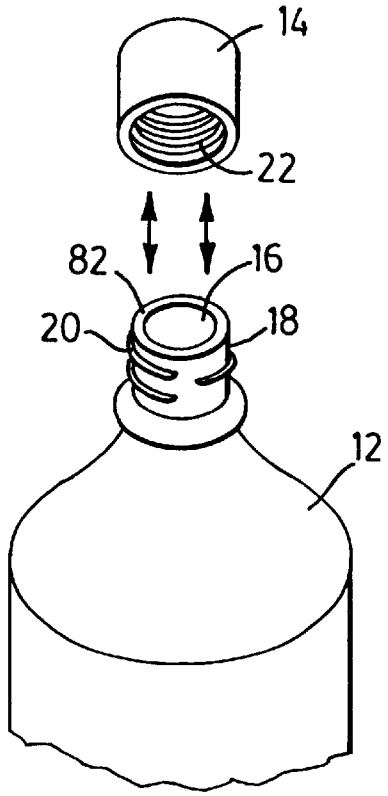
FIG. 1 is a perspective view illustrating the top portion of a standard plastic beverage bottle and a detached cap for this bottle.
Figure 2:
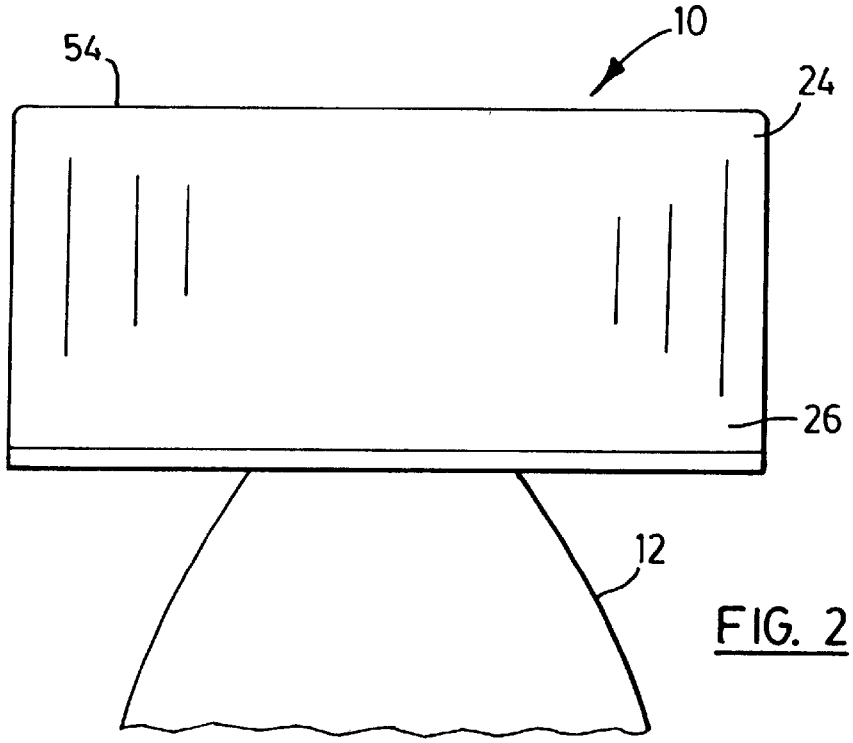
FIG. 2 is a side elevation of the top portion of the plastic bottle with the standard cap replaced by a replacement cap and pressurizing device constructed in accordance with the invention.
Figure 3:
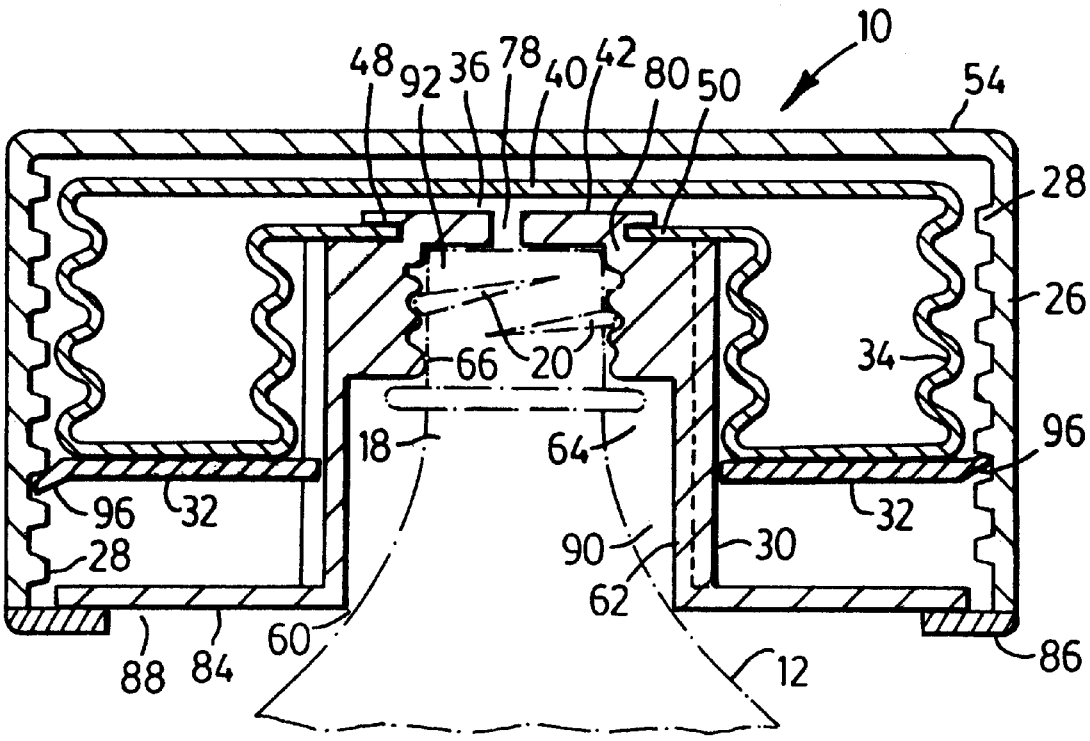
FIG. 3 is a cross sectional elevation of the replacement cap of FIG. 2 mounted on the top of the bottle, the cross section being taken along the line III—III of FIG. 5.
Figure 5:
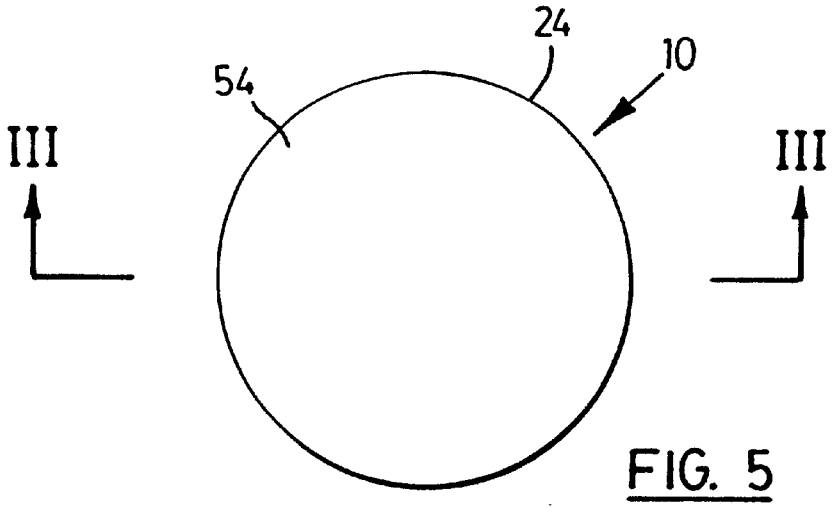
FIG. 5 is a top view of the replacement cap of the invention.

An apparatus for sealing and pressurizing a bottle or container constructed in accordance with the invention is illustrated in FIGS. 2 and 3. This apparatus 10 is a form of replacement cap that is used after the bottle 12 has been opened by the removal of its original threaded plastic or metal cap 14. The bottle 12 can be a standard two liter beverage container typically used to hold a carbonated beverage such as a cola or ginger ale. The standard bottle has an opening 16 in a top end section 18 of the bottle. External threads 20 integrally formed on this top end section extend about the top end section in a circumferential direction. It will be understood that internal threads 22 formed in the original cap 14 are sized and arranged to engage the threads 20 and when these threads are fully engaged, the cap 14 will seal the opening 16. With the use of the present apparatus 10, the original cap 14 is removed and discarded when the bottle is initially opened. The replacement cap 10 of the invention can be used on the beverage container from the time it is opened until the time the container is discarded after its contents have been fully drained through the opening 16. It will be understood that before discarding the container, the apparatus 10 is normally removed so that it can be used again on another container or bottle. The opening 16 can be considered a form of outlet and normally it is the only outlet of the container.

The preferred apparatus 10 of the invention includes an exterior cover member 24 which can be seen in FIGS. 2 to 5. This cover member has a cylindrical side wall 26 that has interior threads 28 formed on the inside thereof for a purpose explained hereinafter. The cover member 24 is a rotatable exterior body that contains the other major components of the apparatus 10 including an internal cap section 30, an annular compressing plate 32 mounted on the cap section, and a resilient, expandable and compressible bellows 34 located above the compressing plate 32 and arranged around the cap section 30. The bellows has an opening 36 for the passage of air into or out of the bellows. The bellows has a central bottom aperture 38 into which the cap section 30 extends and a closed top 40 that extends over a top end 42 of the cap section. The aforementioned opening 36 in the bellows is located centrally in an interior section of the bellows near its closed top 40.

Figure 4:
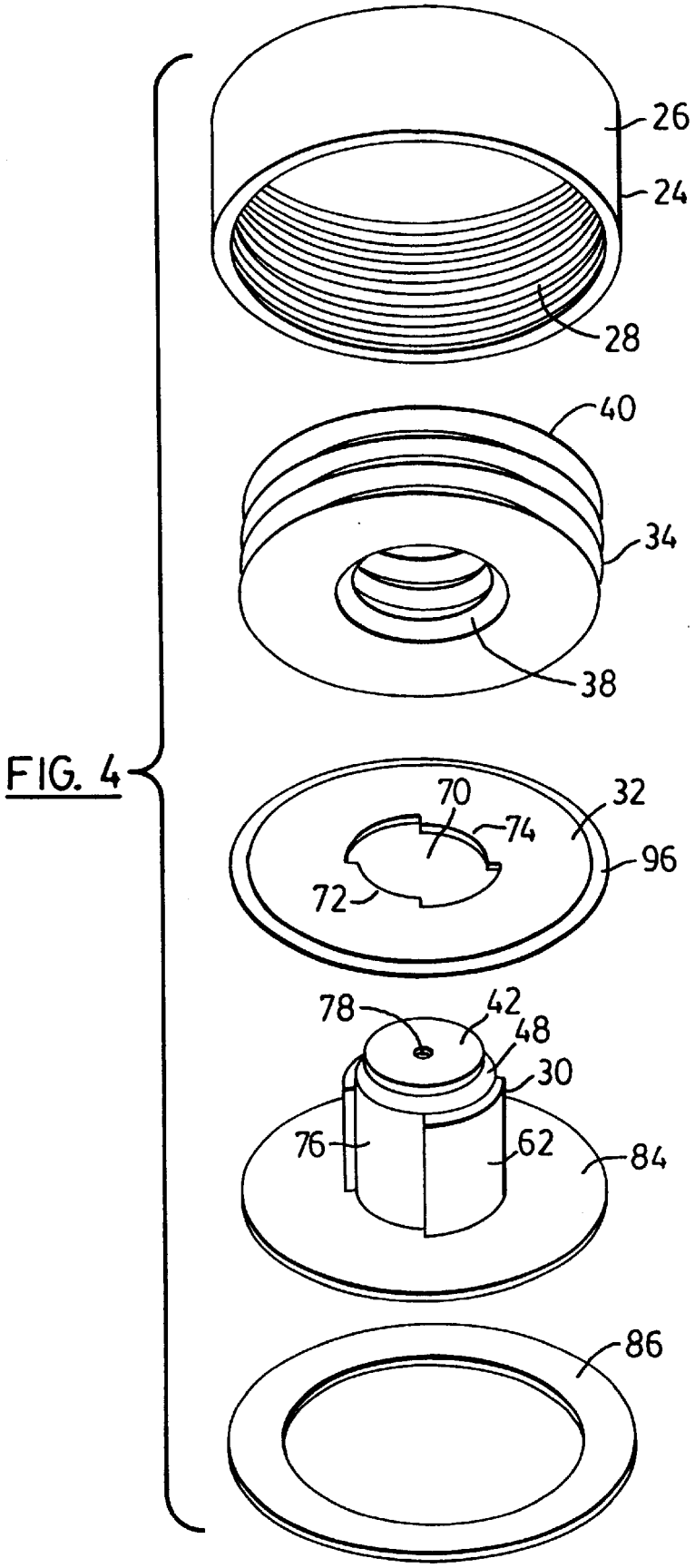
FIG. 4 is an exploded perspective view of the various components which together comprise the replacement cap and pressurizing device.

As shown in FIGS. 3 and 4, the cap section 30 has an annular, outwardly facing groove 48 in its top end 42. The bellows has an internal connecting flange 50 that is mounted in the groove 48. This connecting flange extends around the aforementioned opening 36 for the passage of air into or out of the bellows. It will be seen that the bellows 34 is formed with a central cavity with an open bottom provided by the aforementioned aperture 38. The internal cap section 30 which can be considered a connecting and sealing member extends into this central cavity of the bellows. The exterior cover member 24 includes a top end wall 54 and is adapted to engage and cover the upper end or top 40 of the bellows. This end wall supports the bellows from above. The cover member or body 24 has a substantially open bottom end, a major portion of which can be covered by the cap section as explained below.

Turning to the construction of the internal cap section 30, this section has a bottom end with a bottom opening 60 and a generally cylindrical side wall 62 located between the bottom and top ends and forming a chamber 64 adapted to receive the top end section 18 of the bottle or at least a portion thereof. The cap section 30 has internal threads 66 formed in the chamber and adapted for engaging the external threads on the top end section of the bottle in order to detachably mount the apparatus 10 on the bottle.

The side wall of the cap section has a non-circular external transverse cross section as shown clearly in FIG. 4. The aforementioned compressing plate 32 has a central hole 70 with a similar non-circular periphery having corresponding dimensions close to the dimensions of the transverse cross-section of the side wall 62 whereby the compressing plate is prevented from rotating relative to the cap section 30. However the compressing plate is able to move upwardly or downwardly relative to the cap section. It will be seen that one or more engagement members are provided on at least one of the compressing member or plate 32 and the cap section 30 to prevent rotation of the compressing plate relative to the cap section. In the illustrated preferred embodiment, there are two engagement members in the form of arc-shaped projections 72, 74 formed on opposite sides of the hole 70 and these projections extend into vertical slots or grooves 76 formed in the side wall 62 on the outside thereof. It will be appreciated that instead of two projections, there could be a single projection formed on the plate 32 extending into a single slot on a side wall 62. Also alternatively, projections can be formed on the side wall 62 and these can extend into suitable recessed sections in the periphery of the hole 70.

The top end of the cap section 30 is formed with an air hole 78 for positioning next to the opening 16 in the top end section of the bottle. This hole permits air to flow into and out of the bottle from the interior of the bellows. Instead of one hole there could be two or three or more holes. Also the top end of the cap section has a lower sealing surface located at 80 for sealingly engaging a peripheral surface 82 extending around the opening in the top end section of the bottle during use of the apparatus. The internal cap section 30 has a radially outwardly extending annular bottom flange 84 that, in the illustrated embodiment, extends almost to the side wall 26. Also the cover member 24 includes an inwardly extending flange 86 forming a circular bottom opening at 88 having a minimum width or diameter less than the outer diameter of the bottom flange 84. In this way the flange 86 of the cover member holds the cap section 30 within the cover member. In the illustrated preferred embodiment, the angular flange 86 is made by means of a flat ring member (shown separately in FIG. 4) which can be bonded by adhesive to a bottom edge of the side wall 26.

In the preferred apparatus 10, the chamber 64 in the cap section includes a lower portion 90 having a first diameter exceeding the width of the top end section 18 of the bottle and also an upper portion 92 having a second diameter less than the diameter of the lower portion 90 and approximately equal to the diameter of the top end section of the bottle. The internal threads 66 are formed in this upper portion 92.

The compressing plate 32 is an annular plate having an exterior edge 96.

The internal threads 28 of the cover member 24 engage the exterior edge 96 which preferably is shaped or bent as illustrated in FIG. 3 so as to conform to the gradual slope of the threads, thus maintaining the plate 32 level as shown. It will be appreciated that rotation of the cover member 24 in a predetermined direction, for example clockwise and viewed from above, to a sufficient extent causes the bellows to be compressed by upward movement of the compressing plate 32 relative to the cap section 30. This compression of the bellows forces compressed air to flow from inside of the bellows into the bottle. At the same time the apparatus 10 forms a sealing closure over the opening 16 in the top end section of the bottle. When additional beverage is required from the bottle, it is simply necessary to turn the apparatus 10 in the opposite direction, for example counterclockwise. This will cause the bellows to expand and then cause the threads 66 to disengage from the threads 20 at the top of the bottle, permitting the apparatus to be removed entirely.

It will be appreciated that various modifications and changes can be made to the apparatus 10 of this invention without departing from the spirit and scope of the invention. Accordingly all such modifications and changes as fall within the scope of the appended claims are deemed to be part of this invention. For example, the bellows 34 need not necessarily have the accordion wall configuration as illustrated but can take the form of a simpler, collapsible bag with an opening for air to enter into or flow out of the interior of the bag. The term "bellows" when used herein is deemed to include various types of hollow bags that can be inflated or deflated by a suitable mechanical compressing member such as the illustrated compressing plate 32.

What is claimed is:

1. An apparatus for sealing and pressurizing a bottle having an opening on a top end section and external threads extending about the top end section, said apparatus comprising:

an internal cap section having a bottom end with a bottom opening, a top end, and a generally cylindrical side wall located between said bottom and top ends and forming a chamber adapted to receive at least a portion of the top end section of the bottle, said cap section having internal threads found in said chamber and adapted for engaging said external threads in order to detachably mount said apparatus on the bottle;

an annular compressing plate mounted on said cap section so as to be movable upwardly or downwardly on said cylindrical side wall around which the compressing plate extends, and such that said compressing plate is non-rotatable relative to said cap section;

a resilient, expandable and compressible bellows located above said compressing plate and arranged around said cap section, said bellows having an opening for passage of air into or out of the bellows; and an exterior cover member having a cylindrical side wall that has interior threads formed on the inside thereof in operative engagement with a circumferential edge of said compressing plate, such that rotation of said cover member in a predetermined direction to a sufficient extent causes said bellows to be compressed by upward movement of said compressing plate relative to said cap section, wherein during use of the apparatus, said compression of said bellows forces compressed air to flow from the inside of said bellows into the bottle and said apparatus forms a sealing closure over the opening on the top end section.

2. An apparatus according to claim 1 wherein said bellows has a central bottom aperture into which said cap section extends and a closed top that extends over said top end of the cap section, and said opening in the bellows is located centrally in an interior section of said bellows.

3. An apparatus according to claim 2 wherein said side wall of the cap section has a non-circular, external, transverse cross-section and said compressing plate has a central hole with a non-circular periphery having corresponding dimensions close to the dimensions of said transverse cross-section whereby said compressing plate is prevented from rotating relative to the cap section.

4. An apparatus according to claim 2 wherein said cap section has an annular, radially outwardly facing groove formed in said top end thereof, said bellows has an internal connecting flange that is mounted in said groove, and said connecting flange extends around said opening for the passage of compressed air.

5. An apparatus according to claim 4 wherein said top end of the cap section has a hole formed therein for positioning next to said opening in the top end section of the bottle and said top end of the cap section has a lower sealing surface for sealingly engaging a peripheral top surface extending around the opening in the top end section of the bottle during use of the apparatus.

6. An apparatus according to claim 1 wherein said internal cap section includes a radially outwardly extending, annular bottom flange and said cover member includes a radially inwardly extending flange forming a bottom opening having a minimum width less than the outer diameter of said bottom flange, whereby said flange of said cover member holds said cap section within the cover member.

7. An apparatus according to claim 6 wherein said annular flange on the cover member is a flat ring member bounded by adhesive to a bottom edge of said side wall of the cover member.

8. An apparatus according to claim 1 wherein said chamber in said cap section includes a lower portion having a first diameter exceeding the width of the top end section of the bottle and an upper portion having a second diameter less than said first diameter, said internal threads being formed in said upper portion.

9. An apparatus for sealing and pressurizing a bottle having an opening for allowing a liquid to flow out of the bottle, said opening being formed in an upper section of the bottle having external connecting threads formed thereon, said apparatus comprising:

a connecting and sealing member having a cavity capable of receiving the upper section of the bottle and internal connecting threads extending around the periphery of said cavity and adapted for engaging the external connecting threads of the bottle in order to detachably mount said apparatus on the bottle;

a resilient, expandable and compressible bellows having an opening for passage of air into or out of the bellows;

a movable compressing member for engaging an end of said bellows and capable of compressing same when said compressing member is moved towards said bellows; and a rotatable exterior body containing said bellows and engaging said compressing member so that rotation of said body about a central axis thereof causes said compressing member to move towards said bellows, wherein, during use of said apparatus, compression of said bellows forces compressed air to flow from said bellows through the opening therein and into the bottle and said apparatus forms a sealing closure over the opening in the bottle.

10. An apparatus according to claim 9 wherein said compressing member is an annular plate having an exterior edge and said exterior body has a cylindrical side wall with internal threads formed thereon, whereby said internal threads of the exterior body slidably engage said exterior edge.

11. An apparatus according to claim 9 wherein said bellows is formed with a central cavity with an open bottom and said connecting and sealing member extends into said central cavity.

12. An apparatus according to claim 10 wherein said compressing member is movably mounted on said connecting and sealing member and one or more engagement members provided on at least one of said compressing member and said connecting and sealingly member prevent rotation of said compressing member relative to said connecting and sealing member.

13. An apparatus according to claim 12 wherein said connecting and sealing member has a top end wall with at least one air hole formed therein and said bellows is connected to said connecting and sealing member so that said opening in the bellows is located at said at least one air hole.

14. An apparatus according to claim 10 wherein said exterior body has a top end wall adapted to engage and cover an upper end of said bellows and has a substantially open bottom end.

15. An apparatus according to claim 14 wherein said connecting and sealing member has a substantially cylindrical side wall surrounding said cavity and a radially outwardly extending annular bottom flange at a bottom end of its side wall, and said exterior body includes a radially inwardly extending flange defining a bottom end opening having a minimum width less than the outer diameter of said bottom flange, wherein said flange of said cover member holds said connecting and sealing member within said exterior body.

16. An apparatus for sealing and pressurizing a container having an outlet in one end thereof and external threads extending about said outlet, said apparatus comprising:

a resilient, expandable and compressible bellows having an opening for air to pass into and out of said bellows;

a connecting member for detachably and sealingly mounting said bellows on said container at said outlet, said connecting member being formed with internal threads for engaging said external threads at said outlet and being connected to said bellows;

a movable compressing member for engaging an end of said bellows and capable of compressing same when said compressing member is moved towards said bellows; and a rotatable body engaging said compressing member so that rotation of said body a predetermined amount causes said compressing body to move towards said bellows and compress same, wherein when said apparatus is used and said apparatus is connected to said container, compression of said bellows forces compressed air to flow from said bellows through the opening therein and into said container and said apparatus forms a sealing closure over said outlet.

17. An apparatus according to claim 16 wherein said compressing member is annular and extends around said connecting member and said rotatable body has a cylindrical side wall that is internally threaded, whereby the internal threads of the rotatable body engage an exterior edge of the compressing member.

18. An apparatus according to claim 16 wherein said connecting member forms a cylindrical cavity sized to snugly receive said outlet of the container and having an open bottom and wherein said connecting member has an upper end section adapted to sealingly engage a rim of said outlet when said apparatus is connected to the container at the outlet, said upper end section having at least one aperture for passage of air into said container.

19. An apparatus according to claim 17 wherein one of said compressing member and said connecting member is provided with at least one engagement member that prevents rotation of said compressing member relative to said connecting member by engaging the other of said compressing member and said connecting member.

20. An apparatus according to claim 19 wherein at least a major section of said bellows is annular and forms a central cavity with an open bottom and the annular section of said bellows extends around said connecting member and said bellows is contained in and covered by said rotatable body.

* * * * *